US005467480A

United States Patent [19]

Baudou et al.

[11] Patent Number: 5,467,480

[45] Date of Patent: Nov. 21, 1995

[54] SUPPORT SYSTEM FOR AT LEAST ONE VISOR ON A HELMET

[75] Inventors: Joël Baudou, St Medard en Jalles; Vincent Vitte, Bordeaux, both of France

[73] Assignee: Sextant Avionique, Meudon la Foret, France

[21] Appl. No.: 396,905

[22] Filed: Mar. 1, 1995

Related U.S. Application Data

[63] Continuation of Ser. No. 158,271, Nov. 29, 1993, abandoned.

[30] Foreign Application Priority Data

Dec. 8, 1992 [FR] France ..... 92 14768

[51] Int. Cl.[6] ..... A42B 3/00

[52] U.S. Cl. ..... 2/6.5; 2/424

[58] Field of Search ..... 2/410, 424, 6.1, 2/6.3, 6.4, 6.5, 9, 10

[56] References Cited

U.S. PATENT DOCUMENTS 3,585,638 6/1971 Aileo ..... 2/410
4,887,320 12/1989 Long et al. ..... 2/424

FOREIGN PATENT DOCUMENTS 0290293 11/1988 European Pat. Off. .
1171441 1/1959 France .
2518375 6/1983 France .
1947919 10/1970 Germany .

*Primary Examiner*—C. D. Crowder
*Assistant Examiner*—Michael A. Neas
*Attorney, Agent, or Firm*—Oblon, Spivak, McClelland, Maier, & Neustadt

[57] ABSTRACT

The purpose of this invention is a system to support at least one visor (2*a;* 2*b*) on a helmet (1), the visor being mobile on a slide (30*a;* 30*b*) between an operational position and a withdrawn position.

The system according to the invention comprises, on each side of the helmet (1), a support and guide part (3) including the slide (30*a;* 30*b*), and held on the helmet (1) firstly by an attachment device (4), and secondly by a retaining device (5) preventing the part from leaving the helmet (1).

In the release position, the attachment device (4) completely releases the part (3). However the part remains attached to the helmet by the retaining device (5) such that it can move to the position from which the visor can be extracted from the slide without hitting against the helmet shell (10).

The system in the invention makes it possible to quickly change the visor without the need for tools. It is particularly useful for aircraft or helicopter pilots.

9 Claims, 6 Drawing Sheets

SUPPORT SYSTEM FOR AT LEAST ONE VISOR ON A HELMET

This application is a Continuation of application Ser. No. 08/158,271, filed on Nov. 29, 1993, now abandoned.

BACKGROUND OF THE INVENTION

The invention concerns a support system for at least one visor on a pilot's helmet.

DESCRIPTION OF THE PRIOR ART

In general helmets are designed to protect the pilot when a shock occurs. Consequently they generally comprise firstly a shell protecting the pilot's skull and secondly a visor designed to protect the face and also to provide visual comfort in an aggressive environment (wind, dust, light, fog, etc.).

Various treatments are applied to materials used in visors in order to provide protection against a specific environment. Thus in particular a pilot can choose from transparent anti-glare visors, sun visors, tinted visors for foggy weather, anti-laser visors or even visors treated for nuclear flashes.

In the specific aeronautics field, an aircraft pilot may need to use several visors during his mission, as a function of the environment.

Thus the visor installed on the helmet must be easily and quickly removed and replaced by another visor.

Helmets equipped with several visors have also been developed in order to reduce the need to remove a visor completely to replace it with another. These visors withdraw into the upper part of the helmet to enable the pilot firstly to choose his visor, and secondly to put on and remove his helmet. The pilot can also combine available visors. Visors equipped with sliding blocks mounted in slides have been used to enable the pilot to move the visor between an operational position and a withdrawn position.

Finally, these helmets are generally fitted with an upper cover to protect the visors in the withdrawn position from possible shocks and scratches, etc.

However these known helmets have the following disadvantages:

Firstly, due to weight and size constraints, it is unusual for these helmets to be fitted with more than two visors.

It is therefore necessary to remove all visors in order to change them, either because they are damaged or because they no longer satisfy the pilot's needs for his mission.

Current visor assembly support systems do not satisfy the two criteria of ease and speed of interchangeability. Attachments are made using screws, and in order to change his visor assembly the pilot must use tools such as screwdrivers firstly to remove the assembly from the helmet, and secondly to remove visors from the assembly.

SUMMARY OF THE INVENTION

This invention is designed to reduce the above mentioned disadvantages in known systems by putting forward a support system for at least one visor on a helmet, that facilitates interchangeability of visors and their maintenance in case of damage, and that enables the pilot to easily and quickly reconfigure his equipment himself during a mission without the need for tools.

More precisely, the invention concerns a support system for at least one mobile visor between a withdrawn position and at least one operational position on a helmet of the type comprising a shell, wherein the system comprises the following on each side of the shell:

a visor support and guide part;

an attachment device between the part and the shell; and a retaining device preventing the part from leaving the shell;

the visor support and guide part comprising a slide which contains a visor sliding block that enters through one of its ends, and first and second means at two locations on the visor support and guide part capable of cooperating with the attachment device and the retaining device respectively; the attachment device being rigidly attached to the shell, cooperating with the first means of the visor support and guide part to hold it fixed to the shell when in the attachment position, and to release these first means when in the release position; the retaining device cooperating with the second means when the attachment device is in the release position, to keep the visor support and guide part attached to the shell while leaving it freedom of movement between two positions, a first position for which the visor sliding block may be extracted from the slide without coming into contact with the shell, and a second position for which the attachment device can cooperate with the first means.

BRIEF DESCRIPTION OF THE DRAWINGS

The invention and its advantages will be better understood by reading the following description with reference with the figures in the appendix, that show a preferred but non-restrictive arrangement of the system according to the invention.

DESCRIPTION OF A PREFERRED EMBODIMENT

Figure 1:
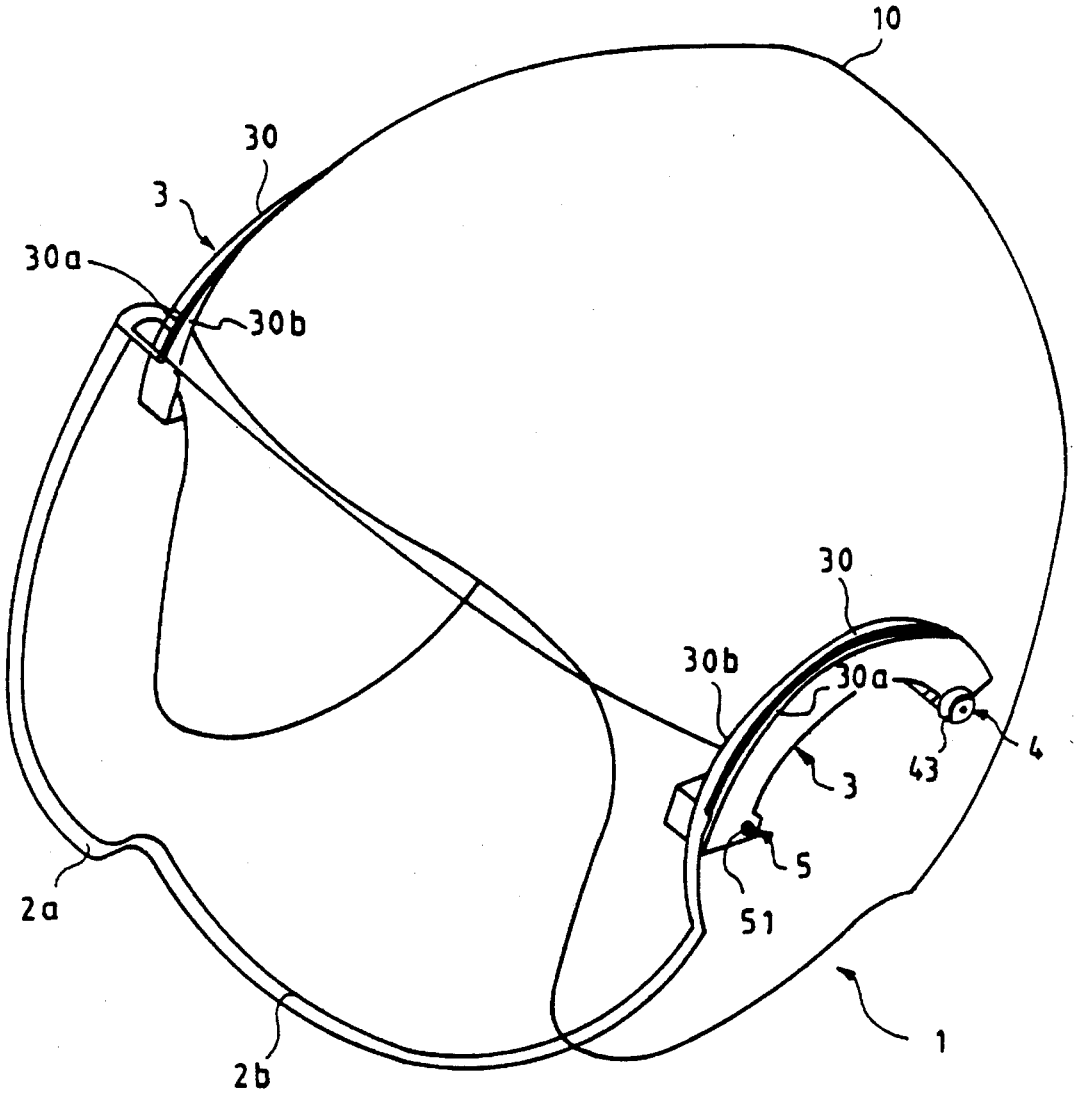
FIG. 1 briefly shows a helmet equipped with two visors maintained by the system according to the invention.

FIG. 1 briefly illustrates the purpose of the invention by showing a simplified view of a pilot's helmet 1 equipped with a support system according to the invention. According to non-restrictive example in FIG. 1, the system shown can hold and guide two visors, one visor 2*a* called the external visor and one visor 2*b* called the internal visor.

More precisely, helmet 1 in FIG. 1 is composed of a shell 10, designed as we have already said, to protect the pilot's skull. Helmet 1 is fitted with the external visor 2*a* and the internal visor 2*b*, these two visors being shown here in combined use, in other words in the lower or operational position.

According to the invention, the support system for these visors comprises two support and guide parts 3 preferably located symmetrically on each side of helmet 1, on the side parts of shell 10. It is useful if these two parts 3 are symmetrical about the plane of symmetry of the shell 10.

In an operational situation, each support and guide part 3 according to the invention is held fixed in a first location on shell 10 of helmet 1 using one attachment device 4 cooperating with the first means (not shown on FIG. 1) located on part 3. In this case the attachment device is in an 'attachment' position. When in a second position called the 'release' position, the attachment device 4 releases the first means of the part, which is no longer attached to the shell 10 at the first location.

Moreover, the support system according to the invention comprises a retaining device 5 on each side of the shell 10, that cooperates with the non-visible second means located at a second location on the part, usefully distinct from the first location, such that the first part remains attached to shell 10 when attachment device 4 is in its release position. In this case, and according to an important characteristic of the invention, the retaining device 5 allows part 3 freedom of movement between two positions, namely a first position at which visors may be easily and completely removed from the helmet, and a second position in which the attachment device 4 may once again cooperate with the first means of part 3.

In the preferred but non-restrictive method of construction shown on the figures, the retaining device 5 is a pivot perpendicular to shell 10, about which part 3 can rotate when the attachment device 4 is in the release position.

The first and second locations, the attachment and retaining positions of part 3, are preferably at the ends of part 3.

On the example shown in FIG. 1, the upper part 30 of the guide and support part 3 is convex shaped and contains two slides 30*a*, 30*b* throughout most of its length, each holding a non-visible sliding block fitted to visors 2*a* and 2*b* respectively. The slides must extend longitudinally along a trajectory that allows the visors to return from their withdrawn position to their operational position.

The operating principle of the system according to the invention is as follows:

During a mission, the pilot can choose to use either one or both visors.

Control means connected to each visor but not shown on FIG. 1 enable the pilot to lower either one or both visors, or to put them in the withdrawn position by moving them along their respective slides.

When the pilot wants to change either one or both visors, he puts the attachment devices 4 of the two parts 3 on each side of the helmet into the release position. According to the invention, parts 3 can then move between two positions, in other words in the case described they can rotate about the spindles of pivot 5. Slides 30*a* and 30*b* also have one end open at the free end of the guide and support parts 3. Thus the pilot can guide the visors along the slides using visor control means not shown on FIG. 1, and can completely remove them from these slides at the open ends.

He can then replace them by other visors that he fits in at the open ends of the slides and then uses control means to slide them along these slides. He then simply pivots the guide parts 3 in the reverse direction and attaches them again to the helmet shell 10 using attachment devices 4.

Figure 2:
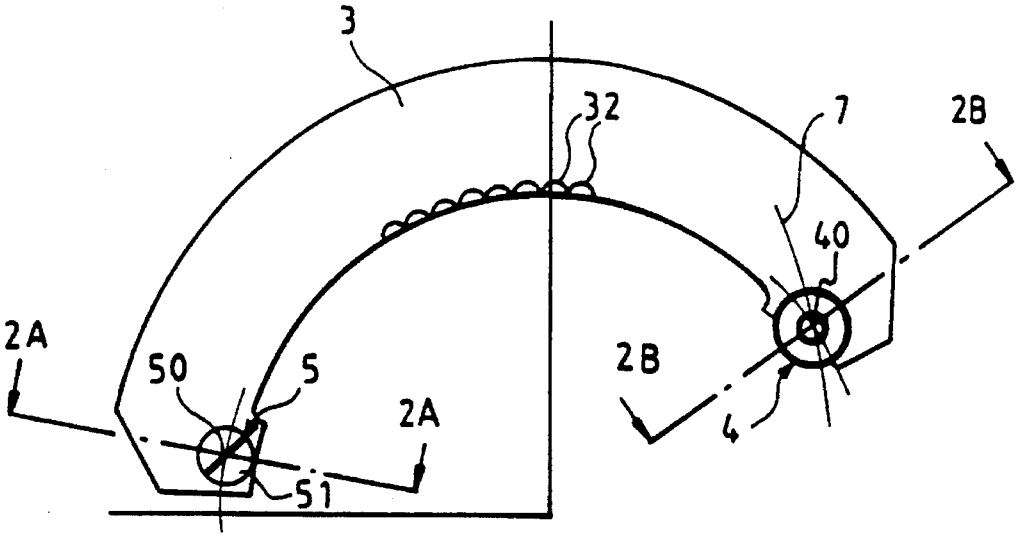
FIG. 2 is a side view of the helmet in FIG. 1 illustrating the system in the invention.

Now that we have completed this brief description of the principle of the system according to the invention, we will make a more detailed description of construction examples of the various elements of the system:

FIG. 2 is a view of the left side of the helmet illustrating the support and guide part 3, comprising first and second non-visible means and, as we have already said, cooperating with the attachment device 4 and with retaining device 5, with spindles 40 and 50 respectively nearly perpendicular to the helmet shell. In this preferred method of construction shown here, the attachment device 4 includes a locking knob 41 and the retaining device 5 includes a screw 51, the use of which we will describe later.

The lower part of part 3 in this case has a concave shape similar to the shape of the slides.

It may also be fitted with notches 32 extending longitudinally over all or part of this lower part, so that visors may be placed in positions intermediate between their withdrawn position and their operational position.

Figure 2A:
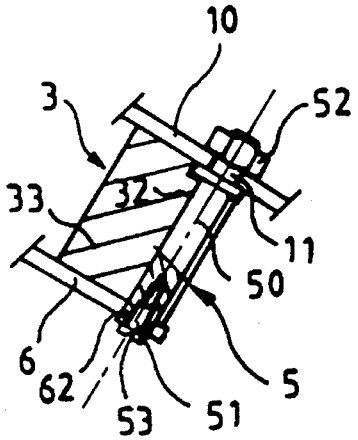
FIG. 2A is a view along section 2A—2A in FIG. 2.

FIG. 2A is a view along section 2A—2A on FIG. 2, illustrating an example of how the pivoting retaining device 5 can be made and how it cooperates with the guide part 3. This figure shows a portion of the helmet shell 10 and a portion of the optional protection cover 6 that is not shown on the previous figures, and the advantages of which we will describe later. The assembly consisting of shell 10, the support and guide part 3, and optionally the cover 6, is held in place by pivot 5 consisting of a spindle 50 passing through a hole 32 formed in part 3, where this hole forms the second means cooperating with the retaining device 4. The two ends of spindle 50 pass through shell 10 through a hole 11, and the protection cover 6 through a hole 62, respectively. These two ends are closed by two attachment elements, for example a nut 52 placed concentrically on spindle 50 on the inside part of shell 10, and by a screw 51 axially fixed in an appropriate housing 53 on spindle 50. According to the invention, the protection cover 6 and the support and guide part 3 can pivot about the pivot 5 spindle 50 in order to change visors. The visor guide part 3 is preferably closed at this specific location through the bottom 33 of the slides, and consequently forms a limit stop defining the lower (operational) position of the visors.

Figure 2B:
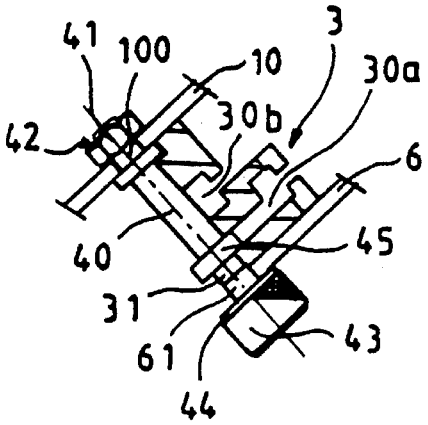
FIG. 2B is a view along section 2B—2B in FIG. 2.

FIG. 2B is a view along section 2B—2B in FIG. 2 illustrating an example of how an attachment device 4 is built and how it cooperates with guide part 3 in the attachment position. This figure shows a portion of the helmet shell 10, a portion of the protection cover 6, and a portion of the guide part 3 with two slides 30*a*, 30*b*. The attachment device 4 may for example consist of a spindle 40 nearly perpendicular to shell 10, and one end of which passes through a hole 100 made in shell 10. This end of spindle 40 is attached to the shell by attachment means, for example a nut 42 that axially closes a threaded end 41 of spindle 40, on the inside of the shell 10. At its second end on the outside of cover 6, spindle 40 is closed for example by a knob 43 forming closing means. This attachment device 4 enables fast attachment and release of part 3. Part 3 and cover 6, if the cover is present, both have an open recess, references 51 and 61 respectively. When the pilot wants to attach part 3 at this location, he moves part 3 and cover 6 towards spindle 40 such that spindle 40 fits in recesses 31 and 61, and then tightens knob 43. Since the diameter of this knob is larger than the recesses, it clamps cover 6 and part 3, thus fixing them to the shell 10. Similarly, part 3 and cover 6 are quickly released by loosening knob 43 and lifting the cover-part assembly along a trajectory shown by curve 7 on FIG. 2. FIG. 2B shown an axial washer 44 positioned after the knob 43, preventing knob 43 from becoming loose during vibrations. A spacer 45 located axially between the two surfaces of the slit on slide 30*a* maintains a separation between these two surfaces when the knob is tightened. Obviously the attachment device 4 that was described with reference to FIG. 2B may be made using any other known means.

Similarly, FIG. 2B shows grooves 30*a* and 30*b* preferably with a different cross-section, to help the pilot know which visor should be put in any one slide. Using the same concept, the part 3 located on the other side of shell 10 has the same slides in the reverse positions.

Figure 3A:
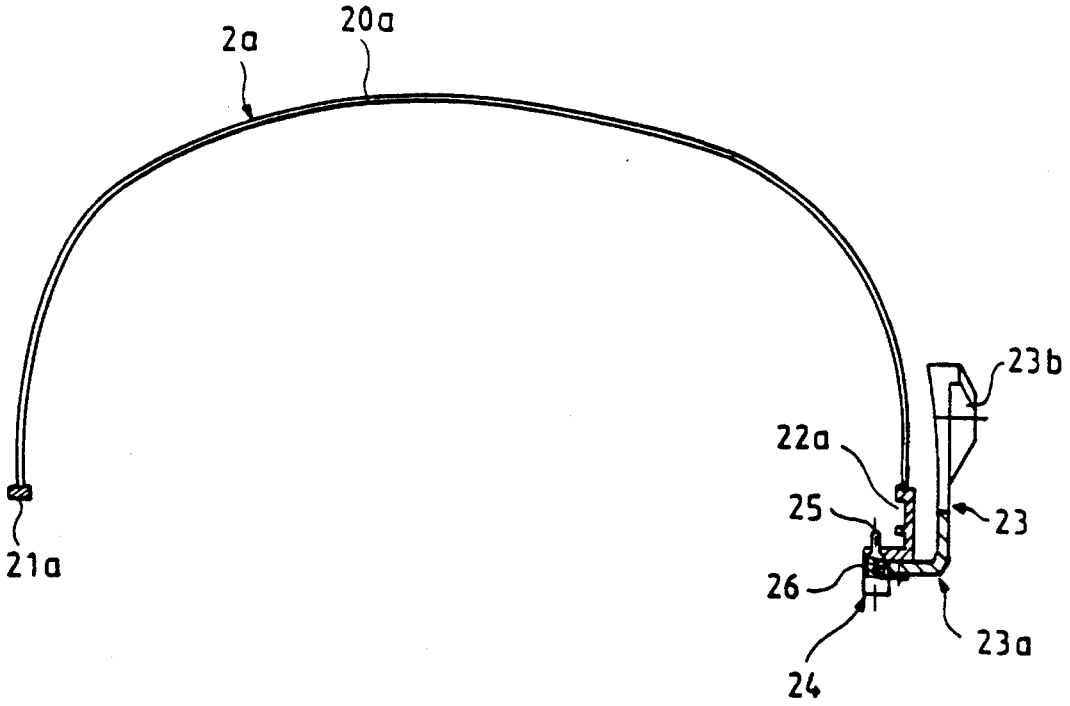
FIGS. 3A and 3B are transverse sections of the external visor 2*a* and the internal visor 2*b* in FIG. 1 respectively.
Figure 3B:
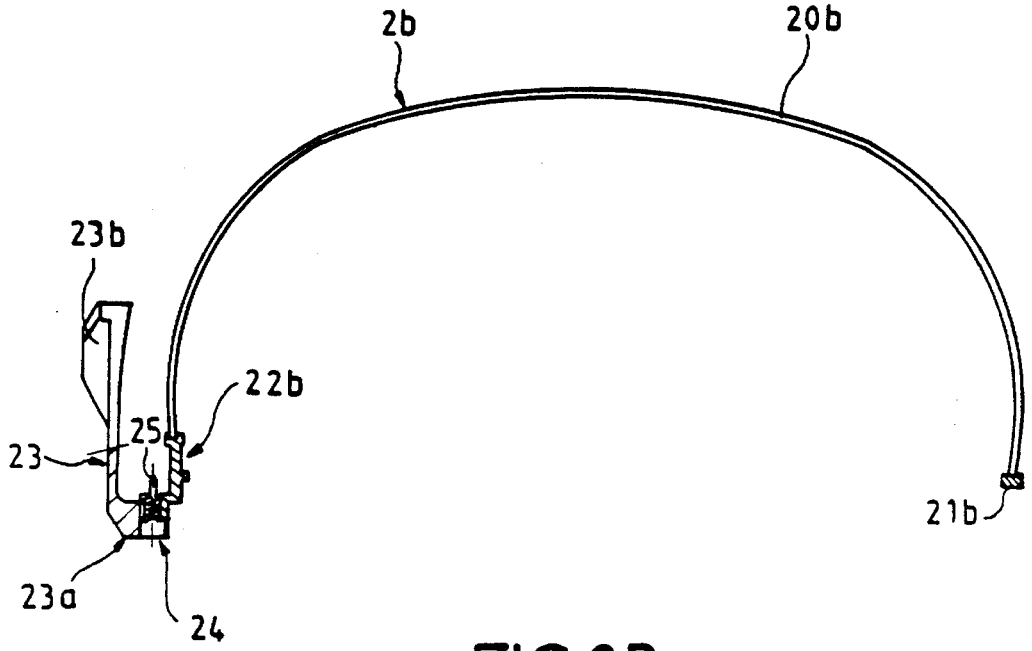

The following description of visors with reference to FIGS. 3A and 3B will help to better understand how visors cooperate with the slides:

FIGS. 3A and 3B are transverse sections of the external visor 2*a* and the internal visor 2*b* respectively. The right part of each figure is designed to cooperate with slides 30*a* and 30*b* on FIG. 2B.

Visor 2*a* (or 2*b*) consists firstly of part 20*a* (or 20*b*) to be placed in front of the pilot's eyes. Each side of visor 2*a* (or 2*b*) is fitted with sliding blocks 21*a*, 22*a* (or 21*b*, 22*b*). The shape of these sliding blocks is different as a function of the shape of the slide in part 3 that will contain them. Visors 2*a* and 2*b* are also equipped with control means 23 enabling the pilot to guide the visors between their various positions on the slides. For example, these control means may consist of an L-shaped lever, one end of which 23*a* is perpendicularly attached to the side of the visor by any known attachment means, and the other end is fitted with a button 23*b*, preferably shaped to make it easy for the pilot to move the lever. When the visor is positioned on the helmet, the button on the control means is on the outside of part 3 and cover 6, so that the pilot can access it. He can then activate the visor in its various positions by pushing or pulling button 23*b* sideways. Preferably, control means for the internal visor will not be on the same side of the helmet as the control means for the internal visor, in order to reduce risks of confusion between the control buttons.

FIGS. 3A and 3B also show an optional indexing device 24 located on the same side of the visor as the control means 23 for this visor. This device is only useful when part 3 is equipped with notches 32 on its lower part (see FIG. 2). When the visor is installed in the slide on parts 3, the upper part of device 24 is a pin 25 that bears against the notches under the action of a spring 26. The pilot can then use control means 23 to choose intermediate positions for his visor.

Figure 4A:
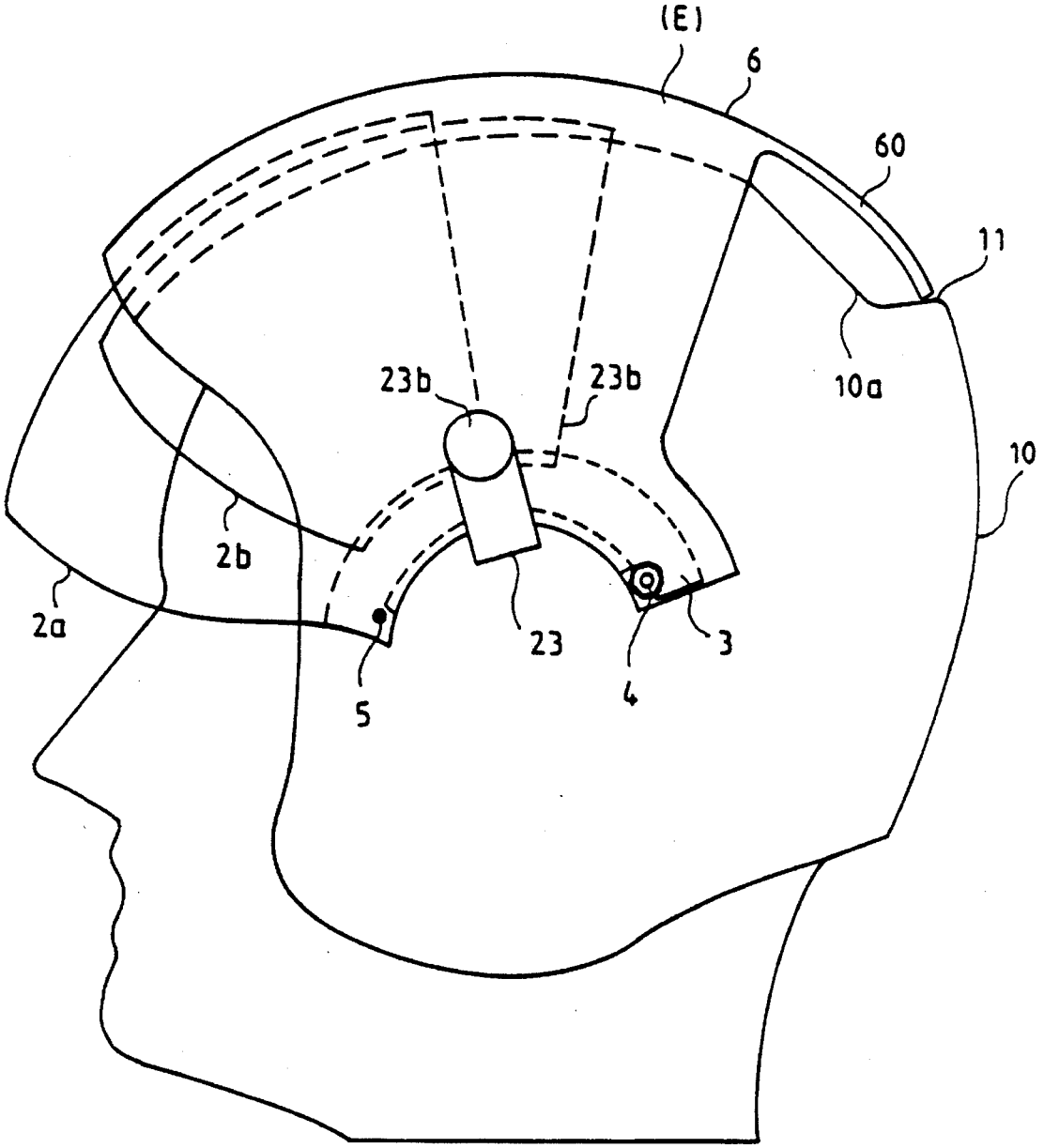
FIGS. 4A to 4C represent different situations showing different steps in the operation of the system according to the invention.
Figure 4B:
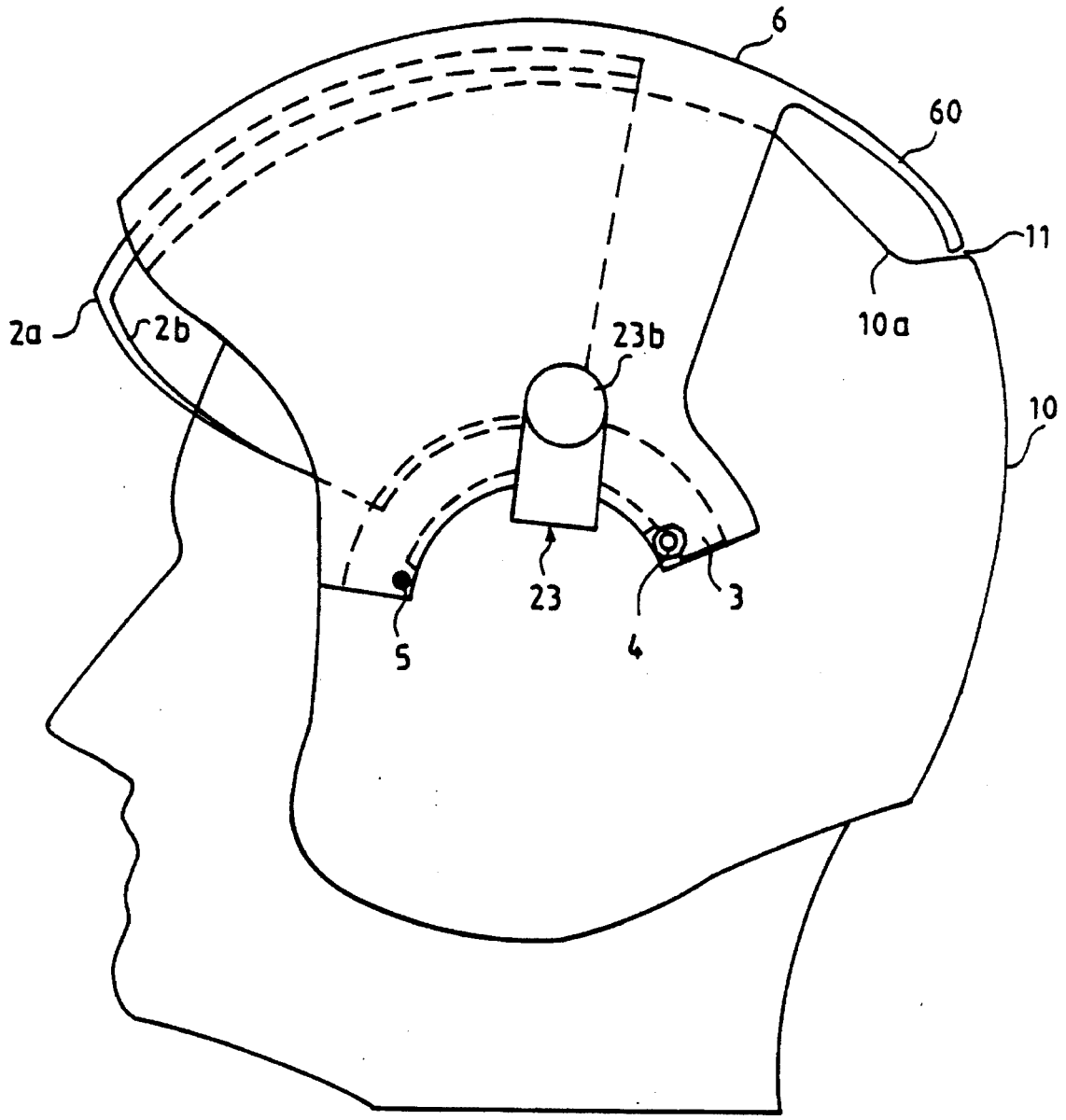
Figure 4C:
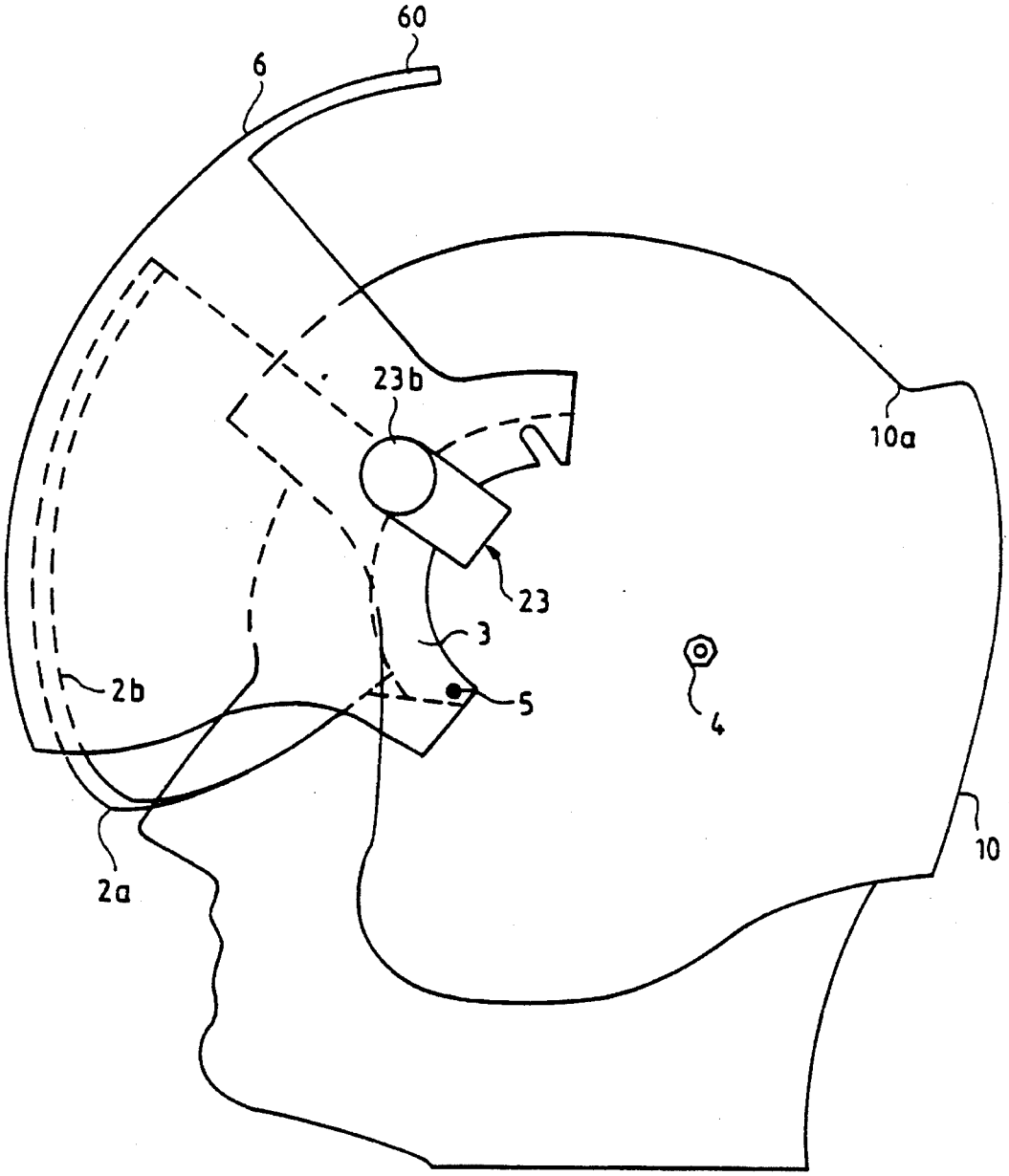

FIGS. 4A, 4B and 4C illustrate different methods of using a helmet fitted with a support system according to the invention. Using the same references as above, these three figures show the helmet shell 10, the external visor 2*a* with its control means 23, the internal visor 2*b*, the support and guide part 3, and the attachment device 4 and retaining device 5.

These three figures also show a protection cover 6 rigidly attached to parts 3, that cover the visors and part 3, without covering the control means 23. This may be beneficial in use. Apart from its initial function of protecting visors when they are in the withdrawn position, cover 6 is rigidly attached to the two parts 3 located on each side of the helmet. Therefore the cover also synchronizes movements of parts 3 in their rotation around pivot 5.

In order to prevent cover 6 from being too large, in the operational position its upper part lies almost along the extension of the shell 10. At the single contact point 11 between cover 6 and shell 10, where part 60 of cover 6 forms a limit stop, there is an offset in the shell 10 so as to leave sufficient space (E) for the passage of the visors.

In the case shown in FIG. 4*a*, the attachment device 4 is in the attachment position, the external visor 2*a* is in the operational position and the internal visor 2*b* is practically withdrawn in the upper part of the shell. The extreme withdrawn position is at device 4, that forms a limit stop in this attachment position.

In the case shown in FIG. 4*b*, the pilot has used button 23*b* on control means 23 to move the external visor 2*a* almost into the withdrawn position. The attachment device 4 is still in the attachment position, part 3 and cover 6 are thus rigidly attached to shell 10.

However in FIG. 4*c*, the attachment device 4 is in the release position. When recesses 31 and 61 on parts 3 and cover 6 have been released, the assembly formed by parts 3, cover 6 and visors 2*a* and 2*b* can pivot around the spindle of pivot 5.

By sliding the visors towards the back of the helmet by using control means 23, they can be completely removed from these slides and replaced by other visors.

Obviously the shapes of parts 3 as shown on the various figures are not in any way restrictive of the system according to the invention.

However they do have the advantage that they are no too large since they have a curved shape following the general trajectory of the slides. These parts 3 shall preferably be made of plastic for weight reasons.

Also, although mobile visors have been shown following a trajectory in a plane parallel to the sides of the helmet, the system according to the invention could be adapted for much more complex trajectories.

Moreover, the two attachment and retaining locations shall preferably be chosen in the shell to satisfy weight distribution constraints on the helmet. For example they could be reversed such that the visors can be removed through the front and not through the back.

We claim:

1. A helmet comprising:

a shell;

at least one visor having a visor sliding block and being movable between a withdrawn position and at least one operational position;

on each side of said shell, a part comprising a slide having an open end and being adapted to receive said visor sliding block, for supporting and guiding said visor between said withdrawn position and said operational position;

first attaching means and second attaching means for attaching said part respectively on a first and on a second location of said shell when the visor is in any position between said withdrawn and said operational positions, said first attaching means including an attachment device for releasing of said part from said first location, said second attaching means including a retaining device for pivoting of said part around said second location, whereby said visor is guided in a third position wherein it can be removed from said part without contacting said shell, by sliding said visor sliding block through said open end.

2. A helmet according to claim 1, wherein said attachment device includes a spindle substantially perpendicular to the shell, said spindle having a first end passing through a hole made in the shell and being fixed to the shell by attachment means, and a second end closed by closing means, and further comprises first means consisting in an open recess in said part that bears against the spindle, said closing means, when tightened, holding said part attached to the shell.

3. A helmet according to claim 2, wherein said spindle has a threaded end, and said attachment means comprises a nut fitting concentrically said threaded end projecting through the inside of the shell.

4. A helmet according to anyone of claims 2 or 3, wherein said closing means consist of a knob placed axially on said second end, the diameter of which is greater than the size of the recess.

5. A helmet according to claim 1, wherein said retaining device acts as a pivot, consisting of a spindle which is substantially perpendicular to the shell, and passes through a hole made in the shell and a hole made in the part, and two attachment means for closing both ends of said spindle.

6. A helmet according to claim 5, wherein the two attachment elements comprise a nut placed concentrically on said spindle on the internal part of the shell, and a screw axially fixed in an appropriate housing in the spindle.

7. A helmet according to claim 1, wherein said part extends longitudinally along the side part of the shell and has a upper convex part comprising said slide over most of its length.

8. A helmet according to claim 1, wherein said part has a lower concave part following the trajectory of the slide, and is fitted with notches extending longitudinally over all or part of the lower part, and cooperating with an indexing device located on the visor so that the visor can have intermediate positions.

9. A helmet according to claim 1, further comprising a protective cover rigidly attached to and covering the two visor support and guide parts, and including an upper part under which the visor is placed in the withdrawn position, inside a space between the shell and the upper part.

* * * * *